US009828700B2

(12) United States Patent
Naskar et al.

(10) Patent No.: US 9,828,700 B2
(45) **Date of Patent: *Nov. 28, 2017**

(54) METHOD FOR THE PREPARATION OF CARBON FIBER FROM POLYOLEFIN FIBER PRECURSOR

(71) Applicant: UT-Battelle, LLC, Oak Ridge, TN (US)

(72) Inventors: Amit Kumar Naskar, Knoxville, TN (US); Marcus Andrew Hunt, Oak Ridge, TN (US); Tomonori Saito, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 135 days.

This patent is subject to a terminal disclaimer.

(21) Appl. No.: 14/672,318

(22) Filed: Mar. 30, 2015

(65) Prior Publication Data

US 2015/0267322 A1 Sep. 24, 2015

Related U.S. Application Data

(63) Continuation of application No. 13/628,463, filed on Sep. 27, 2012, now Pat. No. 9,096,955.

(60) Provisional application No. 61/541,420, filed on Sep. 30, 2011.

(51) Int. Cl.

| | |
|---|---|
| ***C01B 31/00*** | (2006.01) |
| ***C01B 31/02*** | (2006.01) |
| ***C08F 8/34*** | (2006.01) |
| ***C08F 8/36*** | (2006.01) |
| ***C08J 7/14*** | (2006.01) |
| ***D01D 5/04*** | (2006.01) |
| ***D01D 5/06*** | (2006.01) |
| ***D01D 5/08*** | (2006.01) |
| ***D01F 9/14*** | (2006.01) |
| ***D01F 9/20*** | (2006.01) |
| ***D01F 11/04*** | (2006.01) |
| ***D01F 11/06*** | (2006.01) |
| ***D01F 9/21*** | (2006.01) |
| ***D06M 11/52*** | (2006.01) |
| ***D06M 13/248*** | (2006.01) |
| ***D06M 11/54*** | (2006.01) |
| ***D06M 13/256*** | (2006.01) |
| ***D06M 13/262*** | (2006.01) |
| ***D01D 5/24*** | (2006.01) |
| ***D01F 9/10*** | (2006.01) |
| *D06M 11/55* | (2006.01) |
| *D06M 101/20* | (2006.01) |

(52) U.S. Cl.

CPC ..... *D01F 9/21* (2013.01); *D01D 5/24* (2013.01); *D01F 9/10* (2013.01); *D06M 11/52* (2013.01); *D06M 11/54* (2013.01); *D06M 13/248* (2013.01); *D06M 13/256* (2013.01); *D06M 13/262* (2013.01); *D06M 11/55* (2013.01); *D06M 2101/20* (2013.01); *D10B 2101/12* (2013.01); *Y10T 428/2918* (2015.01)

(58) Field of Classification Search

CPC . C01B 31/00; C01B 31/02; C08F 8/34; C08F 8/36; C08J 7/14; D01D 5/04; D01D 5/06; D01D 5/08; D01F 9/14; D01F 9/20; D01F 11/04; D01F 11/06; D06M 11/51; D06M 11/54; D06M 11/55; D06M 13/248; D06M 13/256; D06M 13/262

USPC ..... 264/29.2, 83, 129, 176.1, 184, 205, 264/211.14, 211.16, 211.17, 294; 423/447.1; 427/399, 400; 525/343, 344, 525/353, 354

See application file for complete search history.

(56) References Cited

U.S. PATENT DOCUMENTS

| | | | |
|---|---|---|---|
| 2,796,331 | A | 6/1957 | Kauffman et al. |
| 2,822,321 | A | 2/1958 | Pickard |
| 2,913,802 | A | 11/1959 | Barnett |
| 2,937,066 | A | 5/1960 | Walles |
| 2,957,756 | A | 10/1960 | Bacon |
| 3,011,981 | A | 12/1961 | Soltes |
| 3,027,222 | A | 3/1962 | Wilkinson |
| 3,053,775 | A | 9/1962 | Abbott |
| 3,095,258 | A | 6/1963 | Scott |
| 3,107,152 | A | 10/1963 | Ford et al. |
| 3,107,180 | A | 10/1963 | Diefendorf |
| 3,230,029 | A | 1/1966 | Cappuccio et al. |
| 3,367,851 | A | 2/1968 | Filreis et al. |
| 4,070,446 | A | 1/1978 | Horikiri et al. |
| 4,217,386 | A | 8/1980 | Arons et al. |
| 4,497,789 | A | 2/1985 | Sawran et al. |
| 4,501,641 | A | 2/1985 | Hirakawa et al. |

(Continued)

FOREIGN PATENT DOCUMENTS

| | | |
|---|---|---|
| DE | 1 923 622 | 2/1970 |
| GB | 1 251 822 | 11/1971 |

OTHER PUBLICATIONS

Pyromex® Continuous Filament Tow, *Toho Tenax America, Inc.*, (May 1, 2009).

(Continued)

*Primary Examiner* — Leo B Tentoni

(74) *Attorney, Agent, or Firm* — Scully Scott Murphy & Presser

(57) ABSTRACT

Methods for the preparation of carbon fiber from polyolefin fiber precursor, wherein the polyolefin fiber precursor is partially sulfonated and then carbonized to produce carbon fiber. Methods for producing hollow carbon fibers, wherein the hollow core is circular- or complex-shaped, are also described. Methods for producing carbon fibers possessing a circular- or complex-shaped outer surface, which may be solid or hollow, are also described.

8 Claims, 7 Drawing Sheets

(56) References Cited

U.S. PATENT DOCUMENTS

| | | | |
|---|---|---|---|
| 4,804,577 | A | 2/1989 | Hazelton et al. |
| 4,810,576 | A | 3/1989 | Gaa et al. |
| 5,360,669 | A | 11/1994 | Noland et al. |
| 5,380,580 | A | 1/1995 | Rogers et al. |
| 5,518,836 | A | 5/1996 | McCullough |
| 5,942,288 | A | 8/1999 | Kajander |
| 6,506,323 | B1 | 1/2003 | Han |
| 6,551,353 | B1 | 4/2003 | Baker et al. |
| 6,759,352 | B2 | 7/2004 | Delanoy et al. |
| 7,041,192 | B2 | 5/2006 | Delanoy et al. |
| 7,338,684 | B1 | 3/2008 | Curliss et al. |
| 7,534,854 | B1 | 5/2009 | Paulauskas et al. |
| 7,649,078 | B1 | 1/2010 | Paulauskas et al. |
| 7,786,253 | B2 | 8/2010 | Paulauskas et al. |
| 7,927,701 | B2 | 4/2011 | Curliss et al. |
| 2004/0081829 | A1 | 4/2004 | Klier et al. |
| 2008/0311815 | A1 | 12/2008 | Gupta et al. |
| 2012/0322332 | A1 | 12/2012 | Paulauskas et al. |
| 2013/0084455 | A1 | 4/2013 | Naskar et al. |

OTHER PUBLICATIONS

Shannon M.A. et al., "Science and Technology for Water Purification in the Coming Decades", *Nature*, 452:301-310 (Mar. 20, 2008).

Janney M. et al., "Fabrication of Chopped Fiber Preforms by the 3-DEP Process", *Composites & Polycon*, pp. 1-8 (Oct. 17-19, 2007).

Pyromex® Oxidized PAN Fiber, *Toho Tenax Co., Ltd.*, received Mar. 13, 2006 (precise date of publication not available).

Walker R.A. et al., "Carbon Mats from Melt Spun Polyacrylonitrile Based Precursors for Automotive Composites", *Plastics, Rubber and Composites*, 35(6/7):242-246 (2006).

Du C. et al., "High Power Density Supercapacitor Electrodes of Carbon Nanotube Films by Electrophoretic Deposition", *Nanotechnology*, 17:5314-5318 (2006).

Daley M.A. et al., "Elucidating the Porous Structure of Activated Carbon Fibers Using Direct and Indirect Methods", *Carbon*, 34(10):1191-1200 (1996).

Peebles L.H., "Carbon Fibers Formation, Structure, and Properties", *CRC Press*, pp. 9-19, 24-27 (1995).

Thwaites M.W. et al., "Synthesis and Characterization of Activated Pitch-Based Carbon Fibers", *ACS Spring* (San Francisco), *Symposium on Novel Approaches in Coal Liquefaction*, 37(2):497-504 (1992).

Boyer D.C. et al., "Nonwoven Carbon Fiber Composites", *Tappi Journal*, pp. 97-99 (May 1990).

Postema A.R. et al., "Amorphous Carbon Fibres from Linear Low Density Polyethylene", *Journal of Materials Science*, 25:4216-4222 (1990).

Office Action dated Mar. 9, 2015 in U.S. Appl. No. 13/628,463.

U.S. Office Action dated Jul. 28, 2017 issued in U.S. Appl. No. 14/672,338.

(a)

(b)

(c)

METHOD FOR THE PREPARATION OF CARBON FIBER FROM POLYOLEFIN FIBER PRECURSOR

CROSS REFERENCE TO RELATED APPLICATIONS

The application is a continuation of U.S. application Ser. No. 13/628,463, filed on Sep. 27, 2012, now U.S. Pat. No. 9,096,955, which claims benefit of U.S. Provisional Application No. 61/541,420, filed on Sep. 30, 2011, the contents of all of which are incorporated herein by reference.

This invention was made with government support under Prime Contract No. DE-AC05-00OR22725 awarded by the U.S. Department of Energy. The government has certain rights in the invention.

FIELD OF THE INVENTION

The present invention relates, generally, to methods for producing carbon fiber, and more particularly, wherein such methods include carbonization of a polyolefin fiber precursor.

BACKGROUND OF THE INVENTION

Carbon fiber has previously been produced from polyethylene fiber by liquid immersion sulfonation of the polyethylene fiber (e.g., by treatment with chlorosulfonic or sulfuric acid), followed by pyrolysis. The sulfonation step makes the polyethylene fiber thermally infusible, and thus, carbonizable at the high temperatures employed for carbonization.

However, the liquid immersion sulfonation process, as conventionally practiced, has at least the significant drawback of being either very slow with respect to the degree of sulfonation provided to the polyethylene fiber, or very aggressive such that the reaction is uncontrollable before it achieves equilibrium or complete sulfonation (i.e., a saturated level of sulfonation) of the precursor fiber. Depending on the type of precursor, complete sulfonation preferably occurs through the core of the fiber and maintains a gradient in the degree of functionalization across the filament radius.

Since carbon yield and carbon fiber properties (e.g., strength, brittleness, and fracture toughness) are dependent on the degree of sulfonation, there would be an advantage in adjusting the degree of sulfonation of the precursor in order to accordingly adjust the properties of the carbon fiber. However, the methods known in the art are generally not amenable for such careful adjustment in the degree of sulfonation because the aim has heretofore been to achieve complete sulfonation of the precursor to produce solid carbon fiber.

SUMMARY OF THE INVENTION

In the process described herein, polyolefin fiber precursor is partially sulfonated, i.e., sulfonated below the saturated level of sulfonation commonly practiced in the art, before subjecting the partially sulfonated fiber to a carbonization step. By the partial (i.e., incomplete) sulfonation method described herein, the degree of sulfonation is carefully adjusted. The adjustment in degree of sulfonation is used herein for adjusting the structure and properties (including porosity and surface area) of the resulting carbon fibers.

More specifically, the method includes partially sulfonating the polyolefin fiber precursor to produce a partially sulfonated polyolefin fiber, and subjecting the partially sulfonated polyolefin fiber to carbonization conditions to produce the carbon fiber. In some embodiments, the method includes sulfonating a surface layer (or sheath) of the polyolefin fiber precursor while leaving a core portion of the polyolefin fiber precursor unsulfonated to produce a surface-sulfonated polyolefin fiber. In some embodiments, the surface-sulfonated polyolefin fiber is subsequently subjected to a carbonization step. The carbonization step volatilizes the unsulfonated core portion and carbonizes the surface-sulfonated portion to produce a hollow carbon fiber.

In other embodiments, after sulfonating a surface layer of the polyolefin fiber precursor, the surface-sulfonated polyolefin fiber (or surface-sulfonated tow containing multiple fibers) is subjected, in the absence of an external sulfonating source and in an oxygen-containing (i.e., oxic) environment, to a thermal sulfonation-desulfonation (annealing) process that employs a desulfonation temperature at which gaseous sulfur oxide species are released from the surface-sulfonated polyolefin fiber (or from sulfonated polyolefin segments at the surface layer in filaments of a tow) to migrate toward the core of the surface-sulfonated polyolefin fiber (or toward unsulfonated segments at the core of a tow), thereby further sulfonating the fiber or a tow of fibers toward the core. During the sulfonation-desulfonation reaction, crosslinking of the polymer occurs. Thus, depending on the thermal annealing conditions and degree of sulfonation to start with, a partially sulfonated fiber can result in a more- or less-stabilized fiber. By appropriate adjustment of the desulfonation temperature and residence time at the desulfonation temperature, the thicknesses of the unsulfonated core portion as well as the sulfonated surface layer (i.e., carbonizable surface layer) can be accordingly adjusted. In particular, an increased soak time at a fixed desulfonation temperature increases the carbonizable sheath thickness of the same partially sulfonated precursor fiber. Hence, a method is herein provided for producing a hollow carbon fiber wherein the thickness (size) of the hollow core, as well as carbon wall thickness, can be carefully adjusted and selected. In yet other embodiments, a desulfonation temperature and residence time are selected for partially sulfonating the fiber through the core to produce a solid carbon fiber after carbonization. In another embodiment, when $SO_3$ is produced at high temperature by thermal decomposition of doped sulfates, an inert atmosphere (e.g., $N_2$) is used.

The invention is also directed to methods for producing a hollow carbon fiber. By one method, a hollow carbon fiber is produced by subjecting a multi-component polymer fiber to a carbonization step, wherein the multi-component polymer fiber includes a sulfonated outer layer and an unsulfonated core. The multi-component fiber can be produced from, for example, melt or solution of the respective components. The unsulfonated core is volatilized during carbonization to form a hollow core, and the sulfonated outer layer is carbonized to form a carbon outer layer (i.e., carbon wall). Generally, at least the sulfonated outer layer is or includes a polyolefin or polyolefin derivative. By another method, a hollow carbon fiber is produced by, first, subjecting a multi-component polymer fiber having a non-fugitive polymer outer layer and a fugitive core to a fugitive removal step to produce a hollow polymer fiber. The hollow polymer fiber is then subjected to a sulfonation step followed by a carbonization step to convert the hollow polymer fiber to a hollow carbon fiber. Generally, at least the non-fugitive polymer outer layer is or includes a polyolefin. The hollow core can be circular or non-circular (i.e., complex-shaped, e.g., polygonal in shape).

The invention is also directed to a method for producing a carbon fiber possessing a circular- or complex-shaped (e.g., polygonal-shaped) outer surface. In one embodiment, the method includes subjecting a multi-component polymer fiber to a carbonization step, wherein the multi-component polymer fiber has a completely sulfonated or partially sulfonated core having a circular or complex shape and an unsulfonated outer layer adhered or bonded with the sulfonated core. During carbonization, the unsulfonated outer layer is volatilized and the sulfonated or partially sulfonated core is carbonized to form a carbon fiber having a circular- or complex-shaped outer surface. Generally, at least the completely sulfonated or partially sulfonated core is or includes a polyolefin. In another embodiment, a carbon fiber possessing a circular- or complex-shaped outer surface is produced by, first, subjecting a multi-component polymer fiber composite containing a non-fugitive polymer core having a circular or complex shape adhered or bonded to a fugitive outer layer to a fugitive removal step to produce a polymer fiber having a circular- or complex-shaped outer surface. The polymer fiber having a circular- or complex-shaped outer surface is then subjected to a sulfonation or partial sulfonation step followed by a carbonization step to convert the polymer fiber possessing a circular- or complex-shaped outer surface to a carbon fiber possessing a circular- or complex-shaped outer surface. Generally, at least the non-fugitive polymer core is or includes a polyolefin. These methods provide at least the advantage of being capable of producing smaller diameter precursor filaments with complex shapes from either completely sulfonated, partially sulfonated, or non-sulfonated precursors which can acquire a desired degree of sulfonation.

The invention is furthermore directed to the carbon fiber compositions produced by any of the methods described above. In particular embodiments, the carbon fiber has a complex-shaped (e.g., polygonal-shaped) hollow core. In other embodiments, the carbon fiber has a complex-shaped (e.g., polygonal-shaped) outer surface. In yet other embodiments, the carbon fiber has a circular- or complex-shaped hollow core and a circular- or complex-shaped outer surface. In further embodiments, the carbon fiber composition can be in the form of a tow, mat, or fiber-interlinked (e.g., mesh) material made of any of the carbon fibers produced by methods described above.

The invention is furthermore directed to any of the sulfonated or partially sulfonated carbon precursor compositions described above, including any of the partially-sulfonated polyolefin and multi-component polymer fiber compositions described herein. Since the sulfonated and partially-sulfonated precursor compositions described above generally possess some degree of ionic conductivity and some of the controlled desulfonated-polyolefin yield conjugated polymer and those are generally flexible, they are herein considered for use in applications requiring such a combination of properties, such as in electronic or semiconductor devices, including flexible electronics and printed circuit boards.

DETAILED DESCRIPTION OF THE INVENTION

Figure 1:
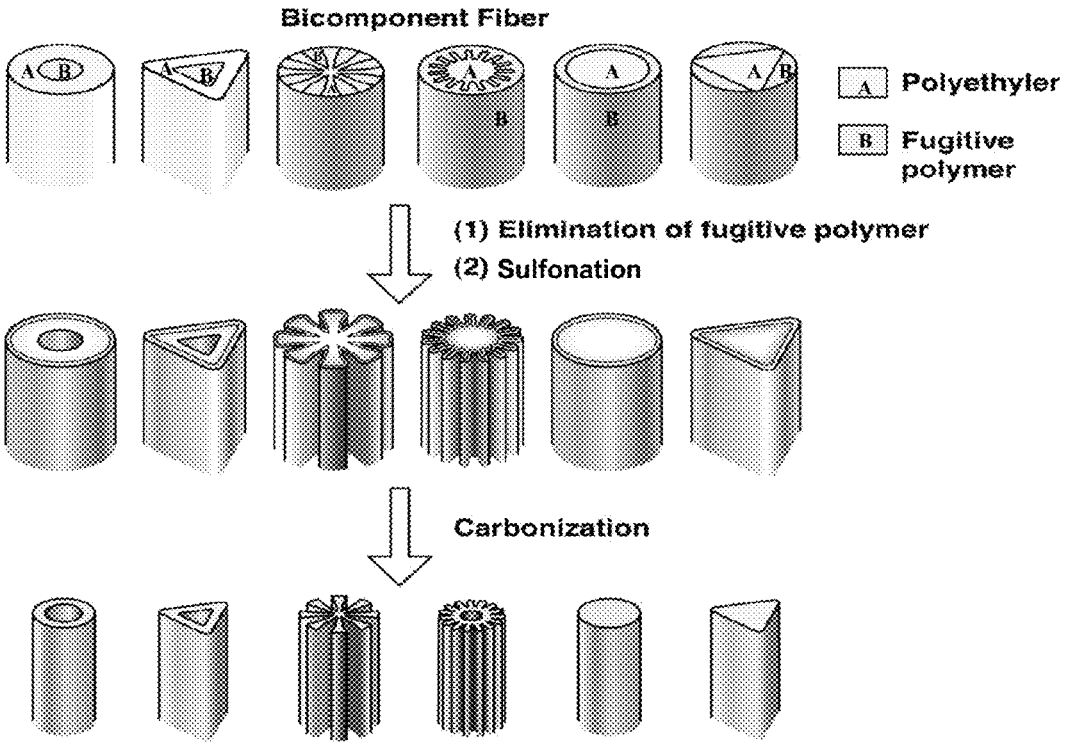
FIG. 1. Schematic illustration showing an exemplary process for producing carbon fibers having a variety of shapes on the outer surface. The method employs a bi-component fiber having an outer soluble fugitive polymer and a polyolefin component (such as a polyolefin core component) having a specified shape. After elimination of the fugitive layer, the polyolefin core component is sulfonated and carbonized to form a carbon fiber having a specified outer shape. A hollow core may also be included by surface layer sulfonation of the polyolefin core component followed by carbonization.

As used herein, the term "about" generally indicates within ±0.5, 1, 2, 5, or 10% of the indicated value. For example, in its broadest sense, the phrase "about 20 μm" can mean 20 μm+10%, which indicates 2012 μm or 18-22 μm.

In one aspect, the invention is directed to methods for the preparation of carbon fiber. In the method, a polyolefin fiber precursor is partially sulfonated before being subjected to carbonization conditions to produce the carbon fiber. The term "carbon" used herein refers to any form of carbon, including amorphous, graphitic, crystalline, and semi-crystalline forms of carbon. In some embodiments, the carbon fiber may have characteristics of a single type of carbon structure throughout the fiber, while in other embodiments, the carbon fiber may have two or more types of carbon structure, e.g., a more pronounced graphitic structure on the outer surface of the carbon fiber and a more pronounced amorphous structure below the surface or in inner layers of the carbon fiber.

The carbon fiber may be non-porous or porous, for both solid and hollow carbon fibers. For carbon fibers that are porous, the porosity considered herein is a result of pores on outer and/or inner surfaces (or layers) of the carbon fiber, typically approximately perpendicular to the length of the fiber or substantially non-parallel to the length of the fiber. For a solid (i.e., non-hollow) carbon fiber, the pores may be on the outer surface (or core segments), and for hollow carbon fibers, the pores may be on the inner surface (i.e., surrounding hollow core). In embodiments where the filaments are made from an already-sulfonated precursor at the core surrounded by a sheath of unsulfonated polymer, a porous structure can be created on the outer layer or surface. The pores may be mesopores, micropores, or macropores, or a combination thereof. Generally, for hollow carbon fibers, the pores are substantially smaller than the diameter of the hollow core (e.g., no more than 5%, 10%, or 20% of the hollow core diameter).

As used herein and as understood in the art, the terms "mesopores" and "mesoporous" refer to pores having a size (i.e., pore diameter or pore size) of at least 2 nm and up to 50 nm, i.e., "between 2 and 50 nm", or "in the range of 2-50 nm". In different embodiments, the mesopores have a size of precisely or about 2 nm, 2.5 nm, 3 nm, 3.5 nm, 4 nm, 4.5 nm, 5 nm, 5.5 nm, 6 nm, 6.5 nm, 7 nm, 7.5 nm, 8 nm, 8.5 nm, 9 nm, 9.5 nm, 10 nm, 11 nm, 12 nm, 15 nm, 20 nm, 25 nm, 30 nm, 35 nm, 40 nm, 45 nm, or 50 nm, or a particular size, or a variation of sizes, within a range bounded by any two of these values.

As used herein and as understood in the art, the terms "micropores" and "microporous" refer to pores having a diameter of less than 2 nm. In particular embodiments, the micropores have a size of precisely, about, up to, or less than 0.5, 0.6, 0.7, 0.8, 0.9, 1.0, 1.1, 1.2, 1.3, 1.4, 1.5, 1.6, 1.7, 1.8, or 1.9 nm, or a particular size, or a variation of sizes, within a range bounded by any two of these values.

As used herein, the terms "macropores" and "macroporous" refer to pores having a size of at least 60 nm. Generally, the macropores considered herein have a size up to or less than 1 micron (1 μm). In different embodiments, the macropores have a size of precisely, about, at least, or greater than 60 nm, 65 nm, 70 nm, 75 nm, 80 nm, 85 nm, 90 nm, 95 nm, 100 nm, 110 nm, 120 nm, 130 nm, 140 nm, 150 nm, 160 nm, 170 nm, 180 nm, 190 nm, 200 nm, 225 nm, 250 nm, 275 nm, 300 nm, 325 nm, 350 nm, 375 nm, 400 nm, 425 nm, 450 nm, 475 nm, 500 nm, 550 nm, 600 nm, 650 nm, 700 nm, 750 nm, 800 nm, 850 nm, 900 nm, 950 nm, or 1000 nm, or a particular size, or a variation of sizes, within a range bounded by any two of these values.

The carbon fiber may also have any suitable surface area, which is very much affected by the level of porosity. In different embodiments, the carbon fiber may have a surface area of precisely, about, at least, greater than, or up to, for example, 5 $m^2/g$, 10 $m^2/g$, 15 $m^2/g$, 20 $m^2/g$, 30 $m^2/g$, 40 $m^2/g$, 50 $m^2/g$, 60 $m^2/g$, 70 $m^2/g$, 80 $m^2/g$, 90 $m^2/g$, 100 $m^2/g$, 150 $m^2/g$, 200 $m^2/g$, 250 $m^2/g$, 300 $m^2/g$, 350 $m^2/g$, 400 $m^2/g$, 450 $m^2/g$, 500 $m^2/g$, 600 $m^2/g$, 700 $m^2/g$, 800 $m^2/g$, 900 $m^2/g$, or 1000 $m^2/g$, or a surface area within a range bounded by any two of the foregoing values.

The polyolefin fiber precursor is typically polyethylene, polypropylene, or a homogeneous or heterogeneous composite thereof, or a copolymer thereof. In the case of polyethylene, the polyethylene can be any of the types of polyethylene known in the art, e.g., low density polyethylene (LDPE), linear low density polyethylene (LLDPE), very low density polyethylene (VLDPE), high density polyethylene (HDPE), medium density polyethylene (MDPE), high molecular weight polyethylene (HMWPE), and ultra high molecular weight polyethylene (UHMWPE). In the case of polypropylene, the polypropylene can also be any of the types of polypropylenes known in the art, e.g., isotactic, atactic, and syndiotactic polypropylene. The polyolefin precursor may also be derived from, or include segments or monomeric units of other addition monomers, such as styrene, acrylic acid, methacrylic acid, methyl acrylate, methyl methacrylate, and acrylonitrile.

The polyolefin fiber precursor (and corresponding carbon fiber) can have any desired thickness (i.e., diameter). For example, in different embodiments, the fiber can have a thickness of 0.1, 0.2, 0.5, 1, 2, 5, 10, 15, 20, 30, 40, 50, 60, 70, 80, 90, or 100 microns, or a thickness within a range bounded by any two of these values. In some embodiments, the fiber is in the form of a tow, while in other embodiments the fiber is in the form of a single filament. Continuous filaments or tows from very low count (<500) to very high counts (>50 k) are considered herein. Such fibers may also be stapled or chopped (short-segment). The polyolefin fiber precursor may also be in the form of a fiber, yarn, fabric, mesh, or felt.

The polyolefin fiber precursor (i.e., "polyolefin fiber") can be produced by any of the methods known in the art. In some embodiments, the fiber precursor is produced by a melt-spinning (i.e., melt-extrusion) process. In other embodiments, the fiber precursor is produced by a solution-spinning process (fiber is produced by coagulation of solid fiber from solution of the polymer in a solvent). The conditions and methodology employed in melt-spinning and solution-spinning processes are well-known in the art. Moreover, the fiber precursor may be produced by a single or bi-component extrusion process. The conditions and methodology employed in single or bi-component extrusion processes are also well-known in the art.

As used herein, the terms "partially sulfonated," "partial sulfonation," "incompletely sulfonated," or "incomplete sulfonation" all have equivalent meanings and are defined as an amount of sulfonation below a saturated (or "complete") level of saturation. The degree of sulfonation can be determined by, for example, measuring the thermal characteristics (e.g., softening or charring point, or decomposition temperature associated with pyrolysis of incompletely sulfonated polyolefin) or physical characteristics (e.g., density, rigidity, or weight fraction of decomposable unsulfonated-polymer segment) of the partially sulfonated fiber. Since rigidity, as well as the softening and charring point (and thermal infusibility, in general) all increase with an increase in sulfonation, monitoring of any one or combination of these characteristics can be correlated with a level of sulfonation relative to a saturated level of sulfonation. In particular, a fiber can be considered to possess a saturated level of sulfonation by exhibiting a constant thermal or physical characteristic with increasing sulfonation treatment time. In contrast, a fiber that has not reached a saturated level of sulfonation will exhibit a change in a thermal or physical characteristic with increasing sulfonation treatment time. Moreover, if the fiber with a saturated degree of sulfonation is taken as 100% sulfonated, fibers with a lesser degree of sulfonation can be ascribed a numerical level of sulfonation below 100%, which is commensurate or proportionate with the difference in thermal or physical characteristic between the partially sulfonated fiber and completely sulfonated fiber. In different embodiments, the fiber precursor is sulfonated up to or less than a sulfonation degree of 95%, 90%, 85%, 80%, 75%, 70%, 65%, 60%, 55%, 50%, 45%, 40%, 35%, 30%, 25%, 20%, 15%, 10%, or 5% relative to a saturated level of sulfonation taken as 100%. The level of sulfonation can be further verified or made more accurate by an elemental analysis.

The polyolefin fiber is partially sulfonated by subjecting the polyolefin fiber to sulfonation conditions that achieve a partial sulfonation of the fiber. The sulfonation conditions considered herein can be any of the processes known in the art in which a polymer fiber is exposed to a source of $SO_x$ species (typically, $SO_2$, preferably in an oxidizing environment, and/or $SO_3$ in an inert environment) for the purpose of sulfonating the polymer fiber, except that, for the purposes of the instant invention, the conditions of the sulfonation process are modified in order to achieve a partial sulfonation of the polymer fiber. Some of the conditions that can be adjusted or suitably selected for the purpose of achieving a partial sulfonation instead of a complete sulfonation include the period of time (i.e., residence time) that the polyolefin fiber is exposed to the sulfonating species, the temperature during exposure to the sulfonating species, and the reactivity and concentration of the sulfonating species. Increases in residence time, processing temperature, and reactivity or concentration of the sulfonating species all result in increased levels of sulfonation. Therefore, one or more of these variables can be suitably minimized to achieve a partial sulfonation.

In one embodiment, the polyolefin fiber is submerged into or passed through a liquid containing sulfur trioxide ($SO_3$) or a sulfur trioxide precursor (e.g., chlorosulfonic acid, $HSO_3Cl$). In some embodiments, the polyolefin fiber is passed through the liquid by pulling the fiber into the liquid from a creel of fiber spool either unconstrained or held at a specified tension. Typically, the liquid containing sulfur trioxide is fuming sulfuric acid (i.e., oleum, which typically contains 15-30% free $SO_3$) or chlorosulfonic acid, or a liquid solution thereof.

In other embodiments, the polyolefin fiber is contacted with a sulfonating gas in a gaseous atmosphere (i.e., not in a liquid). For example, the polyolefin fiber can be introduced into a chamber containing $SO_2$ or $SO_3$ gas, or a mixture thereof, or a gaseous reactive precursor thereof, or mixture of the $SO_2$ and/or $SO_3$ gas with another gas, such as oxygen, ozone, or an inert gas, such as nitrogen or a noble gas (e.g., helium or argon).

In other embodiments, a polyolefin precursor resin is melt-mixed with a sulfonation additive (i.e., sulfonated solid-state material that evolves a $SO_x$ gas at elevated temperatures), and the resulting melt-mixed composite spun to produce a melt-mixed composite fiber. Thus, the melt-mixed composite fiber contains polyolefin precursor resin as an unsulfonated matrix material within which the sulfonation additive is incorporated. The resulting melt-mixed composite fiber (i.e., "melt-spun fiber") is then heated to a desulfonation temperature effective for the liberation of $SO_x$ gas from the sulfonation additive. Liberation of $SO_x$ gas from the sulfonation additive results in partial sulfonation of the polyolefin matrix under an oxic environment. A particular advantage of this melt-mixing methodology is that the amount of sulfonation of the fiber material can be carefully controlled by precisely quantifying the amount of sulfonation material (e.g., by weight or molar ratio of the sulfonation material with respect to total amount of composite material). The sulfonation additive can be any solid-state compound or material bearing reactive $SO_x$-containing groups (typically, —$SO_3H$ and sultone, i.e., —($SO_2$—O)— groups) that function to liberate $SO_2$ and/or $SO_3$ under elevated temperatures. In particular embodiments, the sulfonation additive is an organic (i.e., carbon-containing or carbonaceous) sulfonated compound or material. Some examples of organic sulfonated compounds or materials include sulfonated graphene, sulfonated diene rubber, sulfonated polyolefin, polyvinyl sulfate, sulfonated polystyrene, sulfonated lignin, and sulfonated mesophase pitch. Such organic sulfonated compounds are either commercially available or can be produced by methods well known in the art (e.g., by any of the liquid or gas sulfonation processes known in the art, as discussed above). Inorganic non-metallic sulfates, such as ammonium sulfate, ammonium bisulfate, or other such sulfates, can also be used as a sulfonation additive in the precursor matrix. Moreover, to increase compatibility of the additive with the polyolefin polymer, the sulfonation additive (e.g., graphene or other polycyclic aromatic compound or material) may be functionalized with hydrophobic aliphatic chains of sufficient length (e.g., hexyl, heptyl, octyl, or a higher alkyl chain) by methods well known in the art.

In another embodiment, completely or partially sulfonated polyolefins are plasticized with a suitable (i.e., plasticizing) solvent, such as dimethyl sulfoxide, dimethyl formamide, or sulfuric acid, at varied dilutions and processed in the form of a gel at low temperature in a coagulation bath to obtain solution-spun partially-sulfonated fibers. In particular embodiments, sulfonated additives, such as organic sulfonated compounds, are incorporated into the fiber by doping them into the plasticized polymer gel. Sulfonated additives serve as a source of $SO_x$ gas at elevated temperatures and serve as sulfonating agents in an oxic environment.

The period of time (i.e., residence time) that the polyolefin fiber is exposed to the sulfonating species at the sulfonating temperature, as well as the temperature during exposure to the sulfonating species (i.e., sulfonation temperature) can be suitably adjusted to ensure a level of sulfonation below a complete sulfonation. In some embodiments, the degree of sulfonation (DS) can be determined or monitored at points during the process by use of thermogravimetric analysis (TGA), dynamic mechanical analysis (DMA), or other suitable analytical technique.

The sulfonation temperature is generally below a carbonization temperature, and more typically, at least 30° C., 40° C., or 50° C., and up to 300° C. In different embodiments, the sulfonation temperature is precisely or about 30° C., 40° C., 50° C., 60° C., 70° C., 80° C., 90° C., 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., or 300° C., or a sulfonation temperature within a range bounded by any two of the foregoing values (for example, at least or above 30° C., 40° C., 50° C. and up to or less than 200° C., 250° C., or 300° C.; or at least or above 50° C. and up to or less than 160° C., 170° C., or 180° C.; or at least or above 70° C. and up to or less than 120° C., 140° C., 160° C., or 180° C.).

The residence time at sulfonation is very much dependent on several variables, including the sulfonation temperature used, concentration of sulfonating agent in the reaction medium, level of applied tension (if any), crystallinity of the precursor polymer, and the thickness of the polyolefin fiber. The residence time is also dependent on the sulfonation method used (i.e., liquid or gas phase processes). As would be appreciated by one skilled in the art, the degree of sulfonation achieved at a particular sulfonating temperature and residence time can be replicated by use of a higher sulfonation temperature at a shorter residence time, or by use of a lower sulfonation temperature at a longer residence time. Similarly, the residence time required to achieve a degree of sulfonation in a polyolefin fiber of a certain thickness may result in a higher degree of sulfonation in a thinner fiber and a lower degree of sulfonation in a thicker fiber with all other conditions and variables normalized. However, generally, for polyolefin fibers having a thickness in the range of 0.5 to 50 microns, the residence time at sulfonation is typically no more than 90 minutes to ensure a partial sulfonation (i.e., where sulfonation has not occurred through the entire diameter of the fiber through the core, thus producing a surface-sulfonated polyolefin fiber). In different embodiments, depending on such variables as the sulfonation temperature and fiber thickness, the residence time at sulfonation may be suitably selected as precisely, about, up to, or less than 90 minutes, 80 minutes, 70 minutes, 60 minutes (1 hour), 50 minutes, 40 minutes, 30 minutes, 20 minutes, 10 minutes, 5 minutes, 3 minutes, 2 minutes, or 1 minute, or a residence time within a range bounded by any two of the foregoing values. During sulfonation, a tensile stress of any suitable degree can be employed, such as a tensile stress of 1, 5, 10, or 15 MPa, or within a range thereof. Precursor crystallinity depends on the nature of the polymer and molecular orientation in the fiber form and typically has a value from 0 to 80%.

Generally, for polyolefin fibers having a thickness in the range of 15 to 20 microns, complete sulfonation (i.e., to the core of the fiber) will occur at: a sulfonation temperature of 150° C. or greater when employing a sulfonation residence time of about 5-10 minutes or greater; or a sulfonation temperature of 140° C. or greater when employing a residence time of about 10-15 minutes or greater; or a sulfonation temperature of 130° C. or greater when employing a residence time of about 15-20 minutes or greater; or a sulfonation temperature of 120° C. or greater when employing a residence time of about 20-25 minutes or greater; or a sulfonation temperature of 110° C. or greater when employing a residence time of about 25-30 minutes or greater; or a sulfonation temperature of 100° C. or greater when employing a residence time of about 30-35 minutes or greater; or a sulfonation temperature of 90° C. or greater when employing a residence time of about 35-40 minutes or greater; or a sulfonation temperature of 70° C. or greater when employing a residence time of about 40-45 minutes or greater. Therefore, for any of the foregoing examples, a reduction in sulfonation temperature or residence time should generally have the effect of achieving a partial sulfonation (i.e., a surface sulfonation) for polyolefin fibers having a thickness in the range of 15 to 20 microns.

The above exemplary sulfonation temperatures and residence times are not meant to be taken precisely, but as approximate and typical for polyolefin fibers having a thickness in the range of 15 to 20 microns. For polyolefin fibers having a thickness below the aforesaid range, lower sulfonation temperatures and/or lower residence times will be needed to avoid complete sulfonation (i.e., through the core); and likewise, for polyolefin fibers having a thickness above the aforesaid range, higher sulfonation temperatures and higher residence times can be used while avoiding complete sulfonation. Moreover, generally, for polyolefin fibers having a thickness in the range of 15 to 20 microns, a residence time at sulfonation of 2 minutes is too short to achieve complete sulfonation (to the core of the fiber) at a sulfonation temperature of 160° C. or less, and a residence time of 1 minute or less is generally too short to achieve complete sulfonation at a sulfonation temperature of 200° C. or less. In particular embodiments, a partially sulfonated tow of filaments of 1 to 30 micron thicknesses is produced by varying one or more of the above parameters. The foregoing exemplary combinations of sulfonation temperatures and residence times are particularly relevant to liquid phase and gas phase sulfonation processes described above.

In particular embodiments, particularly when a liquid phase or gas phase sulfonation process is used, the partial sulfonation process results in a surface-sulfonated polyolefin fiber (i.e., which possesses an unsulfonated core). The surface-sulfonated polyolefin fiber is achieved, as discussed above, by judicious selection of sulfonation temperature and residence time, appropriate for the fiber thickness, that halts sulfonation before the entire diameter of the fiber through the core becomes sulfonated. Generally, this is achieved by limiting the residence time at a particular sulfonation temperature to a time below that which would result in complete sulfonation through the core. Moreover, by adjusting the residence time, the thickness of the unsulfonated core and sulfonated surface can be correspondingly adjusted. For example, increasing the residence time at a particular sulfonation temperature would have the effect of thickening the sulfonated surface and narrowing the unsulfonated core, while decreasing the residence time at a particular sulfonation temperature would have the effect of narrowing the sulfonated surface and thickening the unsulfonated core. As further discussed below, this ability to carefully adjust sulfonated surface and unsulfonated core thicknesses is highly advantageous in producing hollow carbon fibers (i.e., after a carbonization step) having precise carbon wall thicknesses and hollow core diameters.

If desired, the thickness of the sulfonated surface and unsulfonated core can be further adjusted by including an autocatalytic solid-state desulfonation-sulfonation step (i.e., "desulfonation step" or "desulfonation process") at the interface of the sulfonated sheath and unsulfonated core (i.e., "sheath-core interface"). During the desulfonation-sulfonation process, the aforesaid interface gradually propagates towards the core. In the desulfonation phase, the surface-sulfonated polyolefin fiber is heated to a desulfonation temperature effective for the liberation of $SO_x$ gas from the sulfonated surface. As the sulfonated sheath is rigid and becomes crosslinked after desulfonation, in the sulfonation phase, $SO_x$ gas molecules liberated from the surface migrate toward the core, thereby partially sulfonating additional polymeric material toward the core. This results in a narrower unsulfonated core and thicker sulfonated surface, or eventually, partial sulfonation throughout the fiber including through the core. The higher the temperature and the longer the residence time at the desulfonation temperature, the narrower the unsulfonated core and the thicker the crosslinked sheath. In some embodiments, the desulfonation temperature is employed for a period of time less than the time required for the entire polyolefin fiber to be partially sulfonated through the core. The instant application also includes the possibility of employing a desulfonation step for a period of time effective to partially sulfonate the polyolefin fiber through the core. In the foregoing embodiment, no unsulfonated core remains.

When a desulfonation process is employed, the desulfonation temperature can independently be selected from any of the sulfonation temperatures and residence times provided above (e.g., at least 30° C., 40° C., 50° C., 60° C., or 70° C., and up to or less than 120° C., 140° C., 160° C., 180° C., 200° C., 250° C., or 300° C.). Moreover, a desulfonation process is generally practiced herein in the absence of an external sulfonating source, thereby not further adding sulfonating species to the fiber, but limiting the amount of sulfonating species to the amount present in the sulfonated surface or the amount incorporated into polymer fiber for a melt-mixed fiber. The desulfonation process is generally practiced herein in an oxygen-containing (i.e., $O_2$-containing) environment, such as air or an artificial oxygen-inert gas atmosphere, which may be conducted at either standard pressure (e.g., 0.9-1.2 bar), elevated pressure (e.g., 2-10 bar), or reduced pressure (e.g., 0.1-0.5 bar). In other embodiments, a pressure of precisely, about, or at least 0.1, 0.2, 0.5, 1, 2, 3, 4, 5, 6, 7, 8, 9, or 10 bar, or a pressure within a range therein, is employed.

In some embodiments, the sulfonation and/or desulfonation process includes exposing the fiber (before, during, and/or after the sulfonation or desulfonation process) to radiative energy. The radiative energy can be, for example, electromagnetic radiation (e.g., ultraviolet, X-ray, infrared, or microwave radiation) or energetic particles (e.g., electron or neutron beam). In the case of electromagnetic radiation, the radiation may be dispersed or collimated, as in a laser. In some embodiments, the radiative energy is ionizing, while in other embodiments it is not ionizing. The fiber may alternatively or additionally be exposed to radiative energy before, during, or after sulfonation and/or carbonization. In some embodiments, electromagnetic or energetic particle radiation is not employed.

The partially-sulfonated polyolefin fiber (whether surface-sulfonated or partially sulfonated throughout the fiber), with or without a thermal annealing or desulfonation step, is then carbonized by subjecting it to carbonizing conditions in a carbonization step. The carbonization step includes any of the conditions, as known in the art, that cause carbonization of the partially sulfonated polymer fiber. Generally, in different embodiments, the carbonization temperature can be precisely, about, or at least 300° C., 350° C., 400° C., 450° C., 500° C., 550° C., 600° C., 650° C., 700° C., 750° C., 800° C., 850° C., 900° C., 950° C., 1000° C., 1050° C., 1100° C., 1150° C., 1200° C., 1250° C., 1300° C., 1350° C., 1400° C., 1450° C., 1500° C., 1600° C., 1700° C., or 1800° C., or a temperature within a range bounded by any two of the foregoing temperatures. The amount of time that the partially sulfonated polyolefin fiber is subjected to the carbonization temperature (i.e., carbonization time) is highly dependent on the carbonization temperature employed. Generally, the higher the carbonization temperature employed, the shorter the amount of time required. In different embodiments, depending on the carbonization temperature and other factors (e.g., pressure), the carbonization time can be, for example, about, at least, or no more than 0.02, 0.05, 0.1, 0.125, 0.25, 0.5, 1, 2, 3, 4, 5, 6, 7, 8, 9, 10, 11, or 12 hours, or within a range therein. In particular embodiments, it may be preferred to gradually raise the temperature at a set or varied temperature ramp rate (e.g., 5° C./min, 10° C./min, or 20° C./min). In particular embodiments, it may be preferred to pass the partially-sulfonated polymer fiber through a furnace with a gradient of temperature at the entrance and exit of the furnace and at a set temperature inside the furnace in order to achieve the desired residence time. In other embodiments, it may be preferred to subject the partially-sulfonated polymer fiber to a sudden (i.e., non-gradual) carbonization temperature. In some embodiments, after the partially sulfonated polyolefin fiber is subjected to a desired carbonization temperature for a particular amount of time, the temperature is reduced either gradually or suddenly.

If desired, the partially sulfonated polyolefin fiber, or alternatively, the carbonized fiber, can be subjected to a temperature high enough to produce a graphitized carbon fiber. Typically, the temperature capable of causing graphitization is a temperature of or greater than about 2000° C., 2100° C., 2200° C., 2300° C., 2400° C., 2500° C., 2600° C., 2700° C., 2800° C., 2900° C., 3000° C., 3100° C., or 3200° C., or a range between any two of these temperatures.

Typically, the carbonization or graphitization step is conducted in an atmosphere substantially devoid of a reactive gas (e.g., oxygen or hydrogen), and typically under an inert atmosphere. Some examples of inert atmospheres include nitrogen ($N_2$) and the noble gases (e.g., helium or argon). The inert gas is generally made to flow at a specified flow rate, such as 0.1, 0.25, 0.50, 1, 5, 10, 20, or 30 L/min. However, one or more reactive functionalizing species may be included in the carbonization step or in a post-treatment step (e.g., at the exit of the furnace as a post-carbonization step) to suitably functionalize the carbon fiber, e.g., by inclusion of a fluorocarbon compound to induce fluorination, or inclusion of an oxygen-containing species to induce oxygenation (to include, e.g., hydroxy or ether groups), or inclusion of amino-, thio-, or phosphino-species to aminate, thiolate, or phosphinate the carbon fiber. Thus, in some embodiments, it may be preferred to include at least one reactive gas, such as oxygen, hydrogen, ammonia, an organoamine, carbon dioxide, methane, a fluoroalkane, a phosphine, or a mercaptan. The one or more reactive gases may, for example, desirably change or adjust the compositional, structural, or physical characteristics of the carbon fiber. The functionalized groups on the carbon fiber can have a variety of functions, e.g., to bind to metal species that are catalytically active, or to modify or adjust the surface miscibility, absorptive, or wetability characteristics, particularly for gas absorption and filtration applications.

The pressure employed in the carbonization (or graphitization) step is typically ambient (e.g., around 1 atm). However, in some embodiments it may preferred to use a higher pressure (e.g., above 1 atm, such as 1.5, 2, 5, 10, 20, 50, or 100 atm, or within a range therein) to, for example, maintain a positive pressure inside the furnace and keep the sample free of oxygen at high temperature to avoid combustion or partial combustion. In other embodiments, it may be preferred to use a lower pressure (e.g., below 1 atm, such as 0.5, 0.1, 0.05, or 0.01 atm, or within a range therein).

In the case of a surface-sulfonated polyolefin fiber having an unsulfonated core, subsequent carbonization volatilizes the unsulfonated core portion to provide a hollow core portion, and carbonizes the surface-sulfonated portion to provide a carbon wall portion. The end result is, thus, a hollow carbon fiber having a hollow core surrounded by a carbon wall. As discussed above, the carbon wall thickness and hollow core diameter can both be precisely adjusted by correspondingly adjusting the sulfonated surface thickness and unsulfonated core thickness during the sulfonation step. In this way, hollow carbon fibers possessing a tailored combination of carbon wall thickness and hollow core diameter can be produced. Such tailoring is highly advantageous for the reason that different applications have different requirements. For example, some applications may require a porous material (e.g., as a filtration material or catalytic support) that also requires high strength, which can be provided by a thicker carbon wall. Other applications not requiring such high strength may use thinner carbon walls. Moreover, some applications (e.g., filtration and gas adsorption) may be better served by thinner pore channels than others, and vice-versa. Depending on the initial thickness of the polyolefin fiber, the carbon wall thickness and hollow core portion can be independently selected to be any desired thickness. Depending on the application, the carbon wall thickness and hollow core portion can be independently selected as, for example, 0.1, 0.2, 0.5, 1, 2, 5, 10, 15, 20, 30, 40, 50, 60, 70, 80, 90, or 100 microns, or a thickness within a range bounded by any two of these values.

In the case of a partially-sulfonated polyolefin fiber that has been partially sulfonated throughout (e.g., in the case of a melt-mixed composite fiber precursor, or a surface-sulfonated polyolefin fiber that has undergone desulfonation to the extent that the fiber is partially sulfonated throughout), subsequent carbonization results in a solid carbon fiber. A particular advantage in using the partial sulfonation process described herein for producing solid carbon fibers is the ability to adjust such properties as carbon yield and carbon fiber properties (e.g., strength, brittleness, and fracture toughness) by appropriate adjustment in the level of sulfonation. Moreover, as complete sulfonation of fibers held in a tow is known in the art to cause undesired interfilament bonding via hydrogen bonding, the described partial sulfonation process can reduce interfilament bonding between fibers by adjusting the degree of sulfonation.

In some embodiments, the sulfonation and desulfonation processes are practiced without applying a stress (tension) along the length of the fiber. In other embodiments, either the sulfonation or desulfonation process, or both, are practiced by applying a stress along the fiber length. The stress can be applied to, for example, avoid fiber shrinkage. In particular embodiments, a high degree of axial stress (e.g., 10 MPa or higher) is applied when a small pore size and narrow pore size distribution is desired. In some embodiments, 0, 0.1, 0.3, 0.5, 1, 2, 5, 10, or 20 MPa of stress is applied in each step involving sulfonation, desulfonation, and carbonization to obtain a desired morphology in the carbonized fiber.

Production of hollow carbon fiber by carbonization of surface-sulfonated polyolefin fiber, described above, will generally result in a hollow channel along the length of the fiber (otherwise referred to as a hollow core or hollow portion) having a circular shape. The term "circular", as used herein, may mean perfectly or substantially circular (i.e., an aspect ratio of precisely 1 or about 1), or circle-like, such as ovoid (e.g., an aspect ratio of up to 1.5, 2, 3, 4, or 5). Although such circular-shaped hollow carbon fibers are highly useful for several applications, there remains a need for producing hollow carbon fibers having any of a variety of non-circular (complex) cores, such as polygonal-shaped and other complex-shaped cores. A similar need exists for producing solid or hollow carbon fibers that have a complex-shaped outer surface. Such complex-shaped carbon fibers, as well as materials made therefrom (e.g., woven or non-woven mats) can be particularly useful or advantageous for numerous applications, including, for example, catalysis, gas absorption, gas separation, water desalination, composite reinforcement, and carbon capturing, and as structural electrodes and current collector materials in composite batteries or energy storage applications. In particular, doping with inorganic catalytic species during precursor fiber processing can produce patterned or non-patterned catalyst or catalyst support media. However, attempts in the art to produce such complex-shaped continuous carbon fibers, particularly those having widely-varied diameters (submicron to 100 micron diameters), have been largely unsuccessful. The instant invention has overcome this significant hurdle of the art by providing versatile methods for the production of a wide variety of complex-shaped carbon fibers, and moreover, on an industrial scale by continuous processing and by relatively facile fabrication methods. Some examples of complex hollow cores or outer surfaces include polygonal (e.g., triangular, square, rectangular, pentagonal, hexagonal, octagonal), polylobal (e.g., trilobal, tetralobal, pentalobal), gear-shaped, and star-shaped cores and outer surfaces.

By a first methodology, production of hollow carbon fiber having a circular- or complex-shaped hollow core begins with a multi-component (for example, bi-, tri-, and tetra-component) polymer fiber composite. The multi-component polymer fiber composite contains a sulfonated outer layer and an unsulfonated core having a circular or complex shape. Intermediate layers may or may not be situated between the outer layer and core. In the multi-component polymer fiber composite, the outer layer, core, and any one or more intermediate layers are bonded or otherwise adhered to each other with a clearly demarcated boundary between layers. For purposes of the instant invention, the clearly demarcated boundary between layers is preferably a result of a multi-component extrusion process, wherein two or more different polymer compositions are extruded together for incorporation as a heterogeneous composite in a single fiber. Multi-component (e.g., bi-component and tri-component) extrusion processes capable of providing a wide variety of complex shapes for each component are well known in the art. In particular, as is well known in the art, a multi-component extrusion process operates, generally, by flowing polymer melts or solutions of different polymer components having distinct elongational rheology characteristics through a designed orifice to form co-extruded or co-ejected filaments. The polymer components are generally immiscible with each other, and moreover, one of the components is sulfonated in order to be carbonized, while the other component is not sulfonated in order to be volatized to form the core. Generally, the sulfonated component is sulfonated (either completely or partially sulfonated) prior to being extruded with the unsulfonated component in the multi-component extrusion process. Preferably, at least the sulfonated outer layer has a polyolefin or polyolefin-derivative composition, and is processed in plasticized form or gel to avoid a thermally-induced desulfonation during extrusion. The unsulfonated complex-shaped core to be volatilized during carbonization can be composed of any thermally removable (vaporizable) material. In preferred embodiments, the unsulfonated complex-shaped core has a composition different from the polymer of the outer layer, and more preferably, a composition that is substantially more vaporizable than the polymer of the outer layer before sulfonation. In particular embodiments, the unsulfonated complex-shaped core (i.e., thermally removable material) has a biopolymeric composition, particularly a biopolyester type of composition, such as polylactic acid (PLA, PLLA, or PDLA), polyglycolic acid (PGA), and polycaprolactone (PCL). In other embodiments, the thermally removable material has a polyalkylene oxide (e.g., polyethylene oxide) composition. The unsulfonated complex-shaped core may also be composed of any of a variety of other volatile polymeric materials, or a volatile solid non-polymeric material, such as a wax, or a compound, such as naphthalene.

By a second methodology, hollow carbon fiber having a circular- or complex-shaped hollow core is produced by a modification of the first methodology, described above, the modification being that the circular- or complex-shaped core portion in the multi-component polymer fiber composite is selected as a fugitive material. Preferably, the fugitive material is a compound or polymer that can be readily dissolved in a solvent. The fugitive material may be any of the materials described above for thermally removable materials. The ready removability of the fugitive core material is to be contrasted with the non-fugitive (i.e., non-removable) outer polymer layer to be carbonized. In particular embodiments, a multi-component extrusion process is used to produce a multi-component polymer fiber composite in which an unsulfonated non-fugitive polyolefin outer layer is adhered (either in the absence or presence of one or more intermediate layers) with a circular- or complex-shaped unsulfonated fugitive core. The fugitive core is removed in a fugitive removal step, e.g., by dissolution by contact with a dissolving solvent (e.g., an organic solvent, such as tetrahydrofuran, methylene chloride, acetone, or an alcohol, or an aqueous sodium or potassium hydroxide solution,) that does not also dissolve or adversely change the polyolefin, or by thermal vaporization, or by chemical reaction to produce a gas. The result is a hollow polyolefin fiber possessing a hollow core having the circular or complex shape of the removed fugitive material. The hollow polyolefin fiber is then completely sulfonated or partially sulfonated, as described above, and the sulfonated hollow fiber subjected to a carbonization step to convert the sulfonated hollow fiber to a hollow carbon fiber having the same or substantially same core shape as the sulfonated hollow fiber.

By a third methodology, carbon fiber having a circular- or complex-shaped outer surface is produced by a modification of the first methodology, described above, the modification being that material selections for the core portion and outer layer are reversed in the multi-component polymer fiber composite. The result is a multi-component polymer fiber composite having a circular- or complex-shaped (e.g., polygonal-shaped) sulfonated polyolefin core and an unsulfonated outer layer. Carbonization of the foregoing multi-component polymer fiber composite results in volatilization of the unsulfonated outer layer along with carbonization of the sulfonated polyolefin core to produce carbon fiber having a circular- or complex-shaped outer surface. By a further modified methodology, similar to the second methodology described above, the multi-component polymer fiber composite can be constructed of a non-fugitive polymer core having a circular or complex shape and a fugitive outer layer, wherein the non-fugitive core and fugitive outer layer are adhered or bonded directly with each other, or indirectly, via intermediate layers. A fugitive removal step is used to remove the fugitive outer layer. The resulting circular- or complex-shaped polyolefin core is subjected to a complete or partial sulfonation step, and then subjected to a carbonization step to produce a carbon fiber possessing a circular- or complex-shaped outer surface. A particular advantage of this methodology is that it can produce very small diameter filaments (e.g., up to or less than 10 micron diameters, and sub-micron diameters) of polyolefin or sulfonated polyolefin. Using conventional means, it is generally highly difficult to produce such small diameter continuous filaments of polyolefin or sulfonated polyolefin. An exemplary embodiment of the above-described alternative methodology is schematically depicted in FIG. 1. The bicomponent fiber depicted in FIG. 1 is also useful in generally exemplifying some of the different core shapes and outer layer shapes possible via multi-component extrusion technology.

For carbon fibers having a circular- or complex-shaped outer surface, as described above in the third methodology, the instant invention also provides a method for further including a hollow core. Thus, in particular embodiments, the carbon fiber possesses a complex-shaped (e.g., polygonal) outer surface and a circular hollow core. Such a combination of features can be attained by modifying the multi-component polymer fiber to have a sulfonated core portion that is surface-sulfonated, i.e., with an unsulfonated inner core portion of the sulfonated core. Thus, after removal of the outer layer, either by volatilization or by a fugitive removal step, the carbonization step causes the surface-sulfonated portion of the sulfonated core to be carbonized and the inner core portion to be volatilized. In other embodiments, a complex-shaped hollow core may be included in a carbon fiber having a complex-shaped outer surface by employing a three-component precursor fiber having a thermally removable or fugitive outer layer, and a core portion containing a complex-shaped outer core portion made of a polyolefin and a complex-shaped inner core portion made of a thermally removable or fugitive material. On subjecting the three-component precursor fiber to thermal treatment or a fugitive removal step, both the outer layer and inner core are both removed, leaving the outer core portion, which can then be sulfonated (if not already sulfonated) and carbonized to produce a carbon fiber having a complex-shaped outer surface and complex-shaped hollow core. In other embodiments, a hollow core can be created in the fiber during fiber manufacturing, when the outer sheath is a fugitive polymer, the outer core is a polyolefin or sulfonated polyolefin, and the inner core is hollow (e.g., air). Such hollow filament manufacturing using multi-component fiber spinning is known in the art. The above-described methods can advantageously provide small diameter hollow carbon fibers and precursors thereof having a complex shape.

In most embodiments, the multi-component extrusion process described above incorporates a single removable core component per fiber. However, by methods available to those skilled in the art, modifications can be made to the multi-component extrusion process in order to produce a composite polymer fiber having more than one (e.g., two, three, four, or a higher multiplicity) removable component along the length of the fiber. Subsequent carbonization of such a composite polymer fiber results in a carbon fiber containing more than one hollow channel along the length of the fiber.

In some cases, the carbon fiber, as produced above, may exhibit less than desirable strength due to partial oxidation of graphitic structures. In such cases, the carbon fiber can be subjected to a reduction process to remove all or a portion of oxidized sites. In particular embodiments, the carbon fiber is treated with a chemical reducing agent (e.g., hydrazine, hydrogen gas, borohydride, or the like) under standard or elevated temperature conditions. The reduction process generally results in a stronger carbon fiber.

In another aspect, the invention is directed to any of the carbon fiber precursor compositions described above, including any of the partially-sulfonated polyolefin fiber, melt-mixed compositions, and multi-component polymer fiber compositions described hereinabove. The precursor composition may be in the form of a fiber, tow, mesh, or in another form (e.g., film, block, ring, tube, or woven or non-woven mat) depending on the application of the precursor composition. In some embodiments, the precursor compositions are partially carbonized, i.e., not completely converted to carbon, or instead, annealed at a temperature that does not convert them to carbon but alters the rigidity, conductivity, or other property of the material. The annealing temperature can be any of the annealing temperatures described above, such as up to or less than 50° C., 100° C., 150° C., or 200° C. In other embodiments, the precursor composition is not annealed. Since the sulfonated and partially-sulfonated precursor compositions described above generally possess some degree of ionic conductivity and some of the controlled desulfonated-polyolefin yield conjugated polymer and those are generally flexible, they are herein considered for use in applications requiring such a combination of properties, such as in electronic or semiconductor devices, including flexible electronics and printed circuit boards.

In still another aspect, the sulfonation-desulfonation methods described above results in a highly conjugated material, such as a highly conjugated polymer, which can be a conducting polymer. In particular embodiments, the highly conjugated material is a planar aromatic composition. Without being bound by any theory, it is believed that the sulfonation process introduces sulfonic acid groups in the polyolefin polymer, which, on desulfonation, undergo an elimination reaction to produce alkene bonds. Thus, by careful quantitation of the amount of sulfonation, by methods described above, followed by an annealing (i.e., desulfonation) step, a network of unsaturated bonds can be produced in the polyolefin polymer to produce the highly conjugated material. In particular embodiments, the highly unsaturated material is in the form of a film. In such cases, the precursor material (i.e., polyolefin) may also be in the form of a film, and processed by sulfonation and annealing steps in the form of a film. The film may have a thickness of, for example, nanometer thickness (e.g., 1, 2, 5, 10, 50, 100, 500, or 1000 nm), or micron thickness (e.g., 1, 2, 5, 10, 50, 100, 500, or 1000 microns), or a thickness within a range bounded by any of the foregoing exemplary thicknesses. The highly conjugated material is typically conductive, and hence, can be employed as a component in an electronic, semiconductor, or photovoltaic device, particularly in applications where an organic conducting composition is desired.

Examples have been set forth below for the purpose of illustration and to describe certain specific embodiments of the invention. However, the scope of this invention is not to be in any way limited by the examples set forth herein.

EXAMPLE 1

Preparation of Carbon Fibers

Materials

Linear low-density polyethylene (LLDPE) was spun into fibers with a varied diameter ranging from 1 to 18 μm by conventional melt-spinning using both single and bi-component extrusion processes. For bi-component spinning, polylactic acid resin was used as the second (fugitive) component that is dissolved in a continuous operation using a tetrahydrofuran solvent bath at 50° C. LLDPE fibers with a trilobal cross-section and circular polylactic acid (PLA) core as well as circular PLA fibers with a star- and gear-shaped LLDPE core of varied diameters (1-18 μm) were spun by bi-component extrusion. Depending on the degree of molecular orientation, the LLDPE fibers have a crystallinity of 50-60% and a tensile strength of 100-170 MPa when tested at 25° C. and at 3 mm/min strain rate for 25.4 mm long single filament specimens on a MTS tensile tester. Fuming sulfuric acid containing 18-24% sulfur trioxide (oleum) was used for sulfonation of the fibers without further purification.

Sample Preparation

A tow of LLDPE fiber was passed through a glass container filled with oleum at 70° C. from a creel of LLDPE fiber spool under constant tension. The fiber tow was pulled by a winder. The degree of sulfonation was controlled by varying the winder speed, which determines residence time, 2-40 minutes. The degree of sulfonation (DS) of the sulfonated LLDPE fibers was determined using thermogravimetric analysis (TGA) at a heating rate of 10° C./min to 1000° C. DS was calculated as a molar ratio of sulfonic acid to polyethylene using a weight loss until 400° C. from TGA as a weight fraction of the sulfonic acid, where all the functional groups on LLDPE were assumed as sulfonic acid or its equivalent in this calculation. After sulfonation, each fiber sample was carbonized according to a variant of the method described by A. R. Postema, et al., "Amorphous carbon fibers from linear low density polyethylene," *Journal of Materials Science,* 25, 4216-4222 (1990). For example, in one run, a tow of sulfonated LLDPE was first heat treated at 165° C. for 10 minutes with a nominal tension of 0.8 mN/filament (~0.3 Pa) before heat-treating the tow at 600° C. for two minutes under the same tension. The third heat treatment was done at 1200° C. for two minutes with no tension. Additional heat treatments at 1700° C. and 2400° C. were also performed for two minutes each with no tension. However, very high temperature treatment at no tension did not improve mechanical properties. In some samples 600 and 1200° C. carbonizations were performed under constant length to restrict shrinkage. Experimental data showed that a tow could tolerate approximately 10 MPa tensile stress during low temperature (150-600° C.) carbonization inside a thermo-mechanical analyzer under nitrogen environment. Further increases in tensile stress caused tow breakage during carbonization. An increased tension during carbonization was found to improve mechanical properties up to an optimal tension level beyond which the mechanical properties deteriorated.

Microscopy

Low-resolution secondary electron micrographs were obtained using a Hitachi S3400 operating at 5 kV and 140 μA. High-resolution secondary electron micrographs were obtained using a Hitachi S4800 operating at 5 kV and 3 μA. Sulfonated LLDPE fibers were imaged using energy dispersive X-ray spectroscopy mapping of sulfur k-alpha X-rays at 4 kV and 70 scans. Transmission electron micrographs of hollow carbon fiber were obtained using a JEOL 2010F FasTEM operating at 200 kV.

Dynamic Mechanical Analysis

Dynamic mechanical analyses on the neat and sulfonated polyethylene fiber bundle were conducted on a RSA3 (TA Instruments) by applying a constant sinusoidal tensile strain of 0.1% over a range of temperatures (−100° C. to 400° C. at 10° C./min) and at a constant frequency of 1 Hz. Storage modulus of the tow was plotted against temperature.

Results and Discussion

Figures 2A, 2B, 2C, 2D:
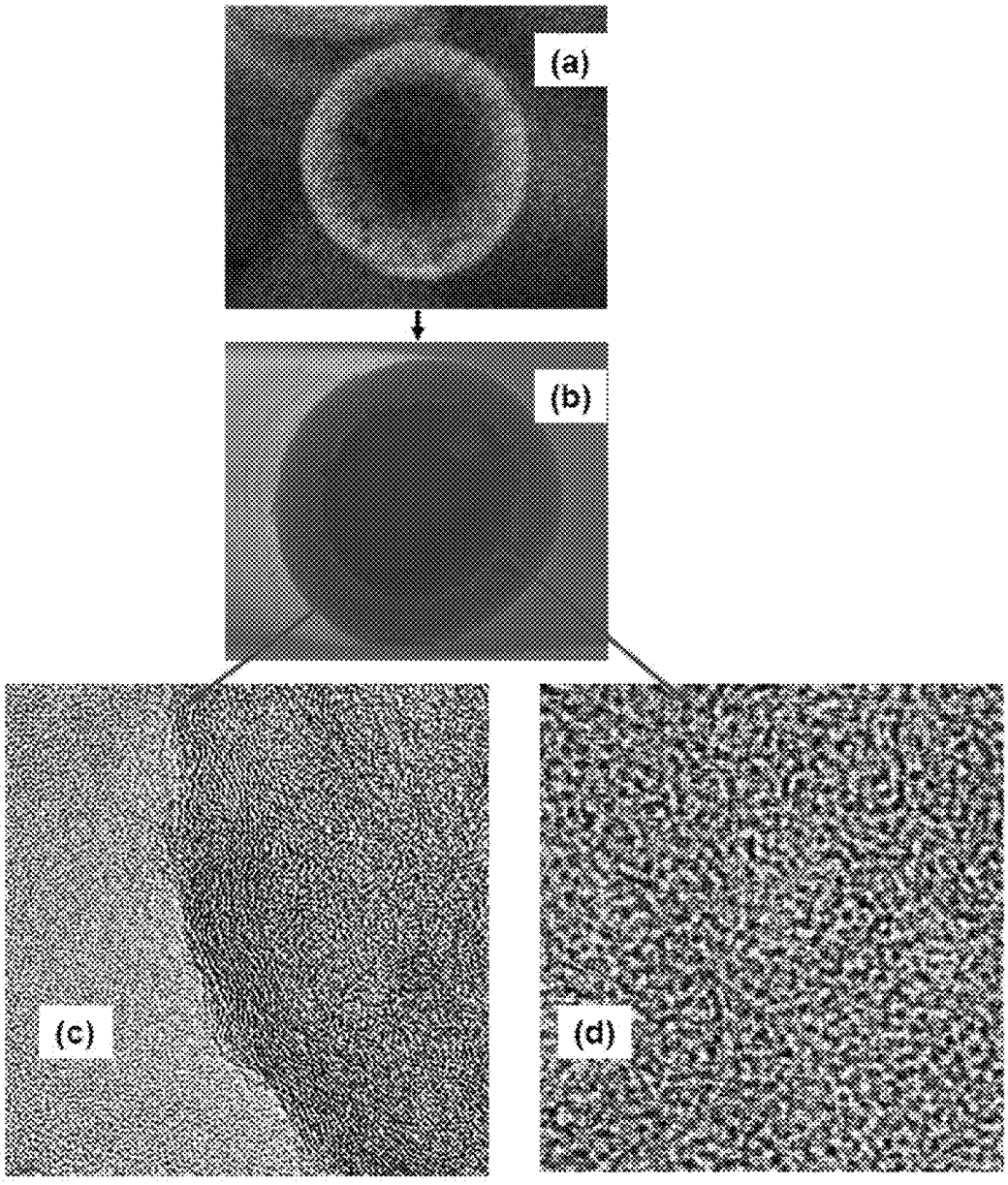
FIGS. 2*a*-2*d*. Depiction of the structure of carbon fiber derived from partially-sulfonated polyethylene. The fiber cross-section in image (a) is a sulfur map from energy-dispersive spectroscopy along with the scanning electron micrograph (b) of a carbonized fiber from the same sample. Transmission electron micrographs of regions near the outer surface (c) and inner surface (d) show differences in graphitic structure.

By controlling the time of the sulfonation reaction, a gradient in sulfur content can be achieved. Sulfur mapping by energy dispersive x-ray spectroscopy on the cross section of a partially sulfonated fiber in a scanning electron microscope (SEM) shows a bright sulfonated skin and distinctly sulfur-free core that appears dark in the image (FIGS. 2*a*-2*d*). FIG. 2*a* depicts distribution of sulfur k-alpha X-rays emitted from sulfonated LLDPE (sulfonation for 21 minutes at 70° C.) when those were exposed to electron beam under vacuum inside the microscope. Non-sulfonated segments volatilize during carbonization, thereby leaving a hollow core. The fiber cross-section in image (a) is a sulfur map from energy-dispersive spectroscopy along with the scanning electron micrograph (b) of a carbonized fiber from the same sample. Transmission electron micrographs of regions near the outer surface (c) and inner surface (d) show differences in graphitic structure.

Figures 3A, 3B, 3C, 3D, 3E, 3F:
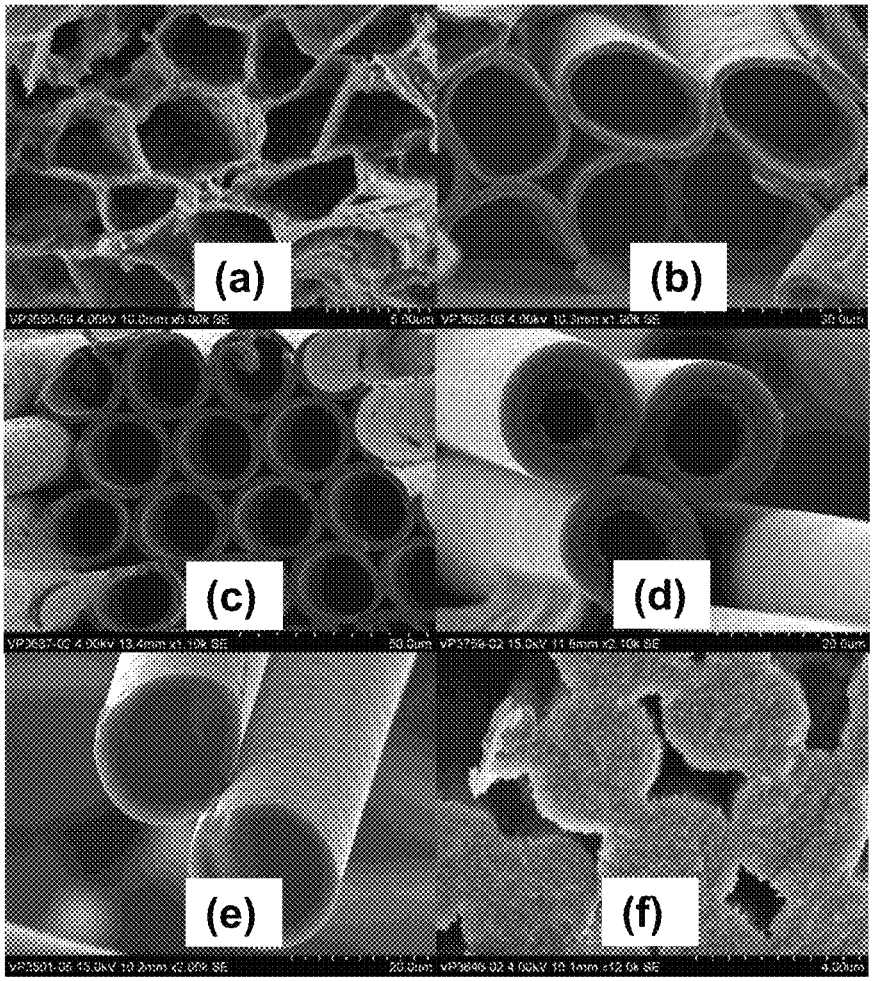
FIGS. 3*a*-3*f*. Scanning electron micrographs of carbon fiber derived from LLDPE precursor fiber sulfonated at 70° C. for different periods of time: (a) 2 minutes sulfonation of 5 μm precursor, (b) 6 minutes sulfonation of 18 μm precursor (1.5 μm wall thickness), (c) 12 minutes sulfonation of 18 μm precursor (2.5 μm wall thickness), (d) 21 minutes sulfonation of 18 μm precursor (4 μm wall thickness), (e) 90 minutes sulfonation of 18 μm precursor (no core), and (f) completely sulfonated 5 μm polyethylene fiber that was sulfonated for 6 minutes at 70° C.

FIGS. 3*a*-3*f* show examples of carbon fibers generated from partial sulfonation of LLDPE with different diameters at 70° C. for different periods of sulfonation time. FIG. 3*a* shows carbon fiber produced from 5 μm LLDPE fiber sulfonated for 2 minutes at 70° C. This resulted in a honeycomb-like structure of hollow carbon fibers. In the case of FIG. 3*a*, the thin fiber walls are shown to have fused together. FIG. 3*b* shows carbon fiber produced from 18 μm LLDPE fiber precursor sulfonated for 6 minutes at 70° C. The resulting hollow carbon fibers have a wall thickness of about 1.5 μm. FIG. 3*c* shows carbon fiber produced from 18 μm LLDPE fiber precursor sulfonated for 12 minutes at 70° C. The resulting hollow carbon fibers have a wall thickness of about 2.5 μm. FIG. 3*d* shows carbon fiber produced from 18 μm LLDPE fiber precursor sulfonated for 21 minutes at 70° C. The resulting hollow carbon fibers have a wall thickness of about 4 μm. FIG. 3*e* shows carbon fiber produced from 18 μm LLDPE fiber precursor sulfonated for 90 minutes at 70° C. The resulting carbon fibers are solid and have no hollow core, thereby indicating complete sulfonation (to be avoided for the purposes of the instant invention). FIG. 3*f* shows carbon fiber produced from 5 μm LLDPE fiber precursor sulfonated for 6 minutes at 70° C. The resulting carbon fibers are solid and have no hollow core. Significantly, for the smaller diameter filaments (e.g., as shown in FIG. 3*f*), a much shorter time resulted in complete sulfonation than for larger diameter filaments (e.g., as shown in FIG. 3*e*) at the same temperature.

Figure 4:
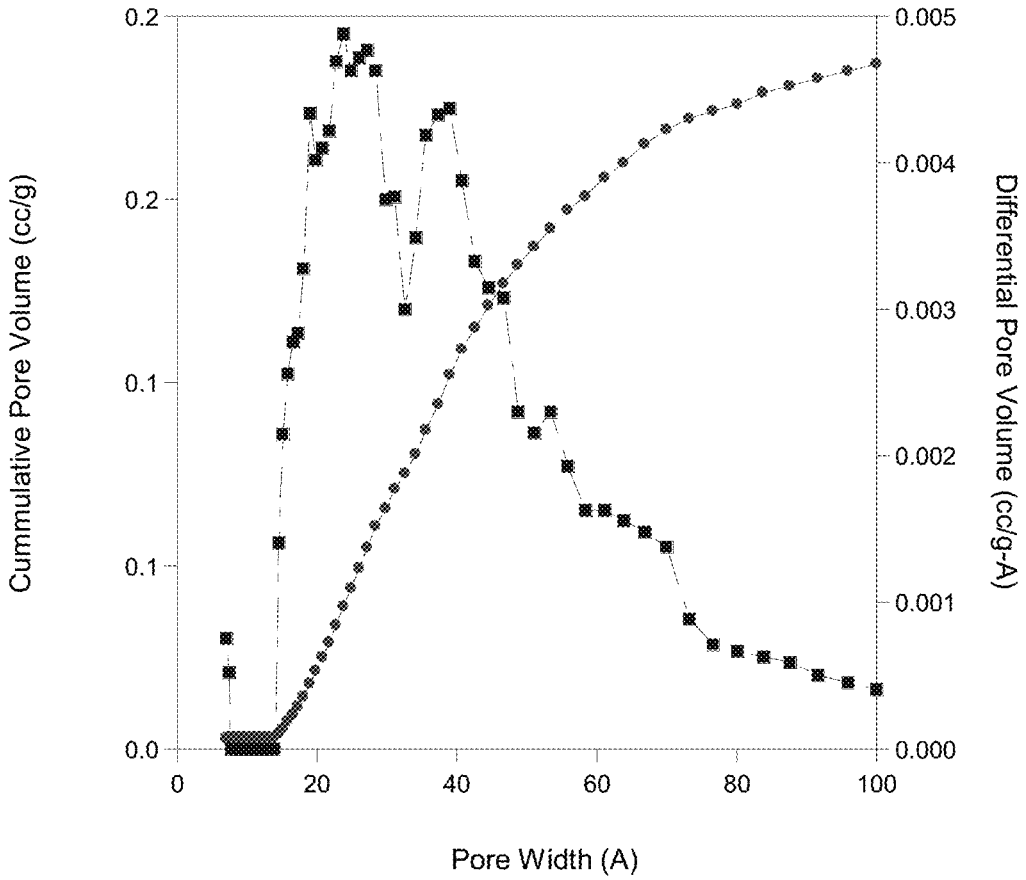
FIG. 4. Pore size distribution using DFT analysis for an 18 μm hollow fiber with a nominal wall thickness of 4 μm. Cummulative pore volume is represented by circles and differential pore volume is represented by squares.

Without being bound by any theory, the porosity in the carbonized fiber may be attributed to sulfur-containing moieties (e.g., sultone ring groups) that volatilize during carbonization. A similar morphology has been observed in activated carbon fiber that is generated by heat treatment in $CO_2$ (M. A. Daley, et al., "Elucidating the porous structure of activated carbon fibers using direct and indirect methods," Carbon, 34 (10), 1191-1200 (1996)). The $SO_x$ species evolved from sulfonated LLDPE during heat treatment may act in much the same way as $CO_2$, thereby providing a novel route for generating porous and activated carbon fiber. The surface area of solid LLDPE-based carbon fiber was found to be generally about 15 $m^2/g$ while the fiber in FIG. 2*b* was found to be about 80 $m^2/g$. Similar samples of hollow carbon fiber can yield surface areas up to 500 $m^2/g$. The pore size distribution was obtained from DFT analysis of adsorption isotherms (FIG. 4). As shown, there appears to be a mixture of microporosity and mesoporosity based on the population of pore sizes present.

The inner and outer surfaces also have slightly different atomic structures as evidenced by the transmission electron micrographs in FIGS. 2*c* and 2*d*. Although graphitic structures are present near both the inner and outer surfaces, the planes near the inner surface are smaller than the planes near the outer surface. This is because the sulfonation reaction in neat fibers occurs at a much greater extent near the outer surface of the fiber compared to the fiber core which includes the inner surface region. Nonwoven mats from melt-processed polyethylene fibers either in continuous or staple forms were converted to carbon mats via sufonation and subsequent carbonization.

As observed in mesoporous carbon, these nonwoven mats from hollow carbon fibers should demonstrate significant ion exchange capabilities (M. A. Shannon et al., "Science and technology for water purification in the coming decades," *Nature,* 452, 301-310 (2008)). Thus, these functional carbon materials can be used as filters for water desalination. Because of diffusion-controlled nature of sulfonation reaction and the radial gradient in the degree of sulfonation, the pore sizes in the carbonized fiber (solid or hollow) increases from outer skin to the core of the fiber or inner surface. Carbon mats made from such staple and hollow fiber can be used as gas separation membranes.

Figure 5:
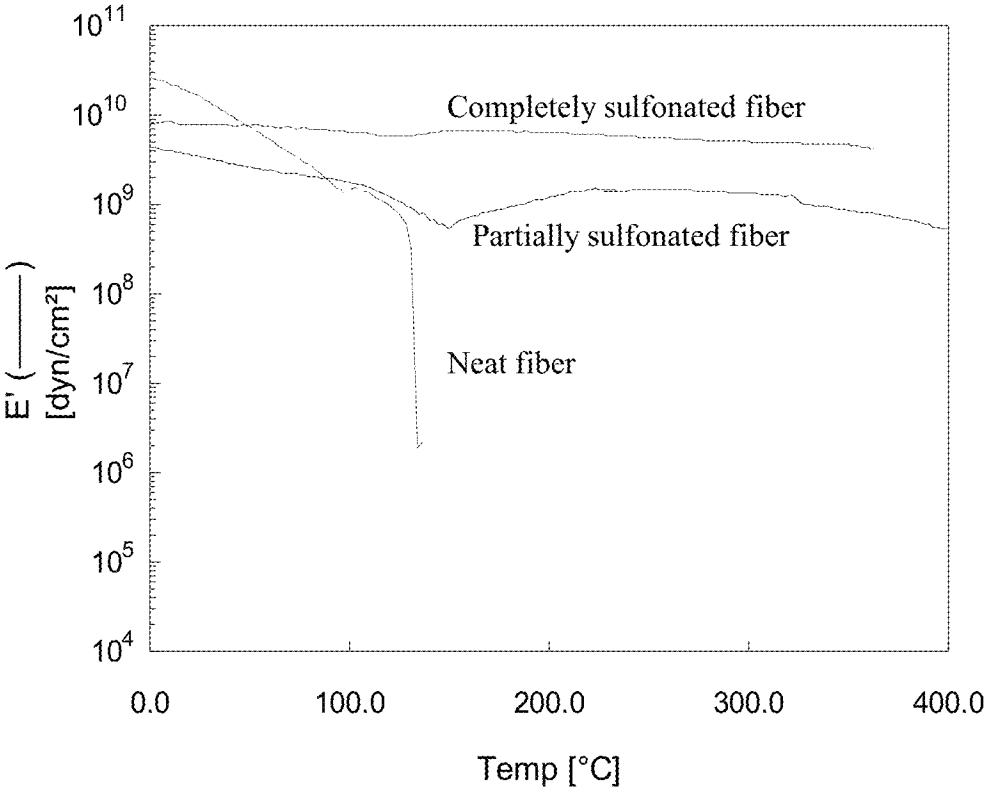
FIG. 5. Dynamic mechanical storage modulus profile of polyethylene filaments treated by complete and incomplete sulfonation.

The porous structure obtained in completely- or partially-sulfonated polyolefins are presumably due to elimination of sulfonated groups or pyrolysis of unsulfonated polyethylene segments. As shown in FIG. 5, completely-sulfonated fiber does not show significant change in modulus (E') at a temperature close to melting point of neat fiber. Unsulfonated or neat fiber melts and exhibits discontinuity in the dynamic mechanical data collection beyond melting transition of the fiber (135° C.). Partially-sulfonated fiber exhibits partial melting and a decrease in modulus due to softening; however, beyond melting point of the fiber, the modulus increases due to crosslinking and subsequent reaction by desulfonation, and the modulus nearly levels off.

Figures 6A, 6B, 6C, 6D, 6E, 6F, 6G, 6H, 6I:
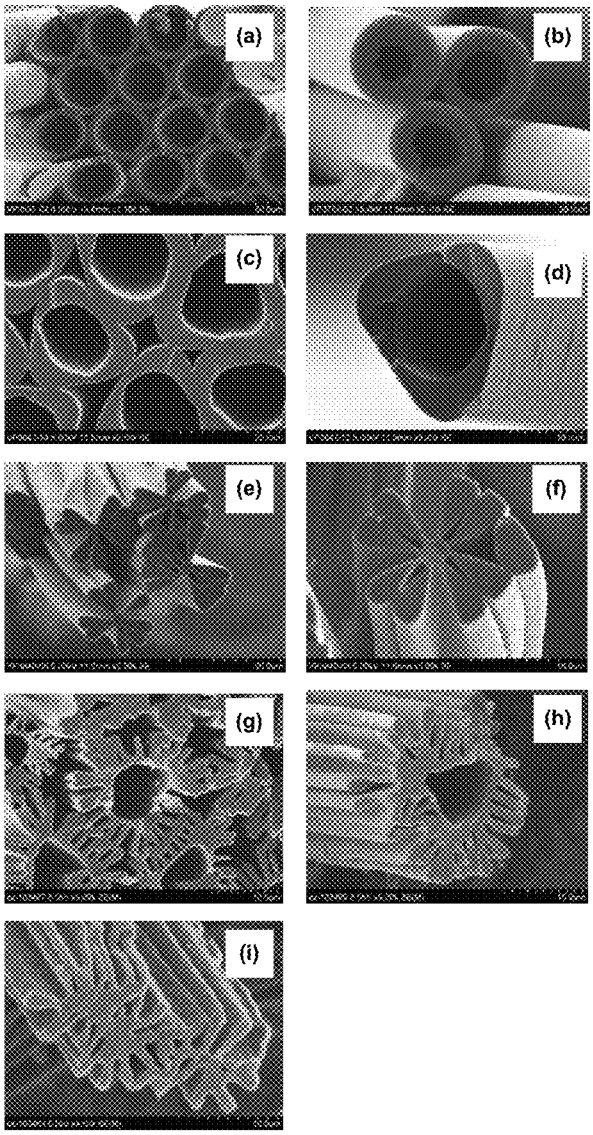
FIGS. 6*a*-6*i*. SEM micrographs of patterned polyethylene-based carbon fiber.

FIGS. 6*a*-6*i* are scanning electron micrographs of patterned polyethylene-derived carbon fiber and nonwoven mats. The carbon fibers shown in FIGS. 6*a* and 6*b* are from polyethylene fibers that were sulfonated at 70° C. for 12 minutes (FIG. 6*a*), and 21 minutes (FIG. 6*b*). The carbon fiber shown in FIGS. 6*c* and 6*d* are from completely sulfonated polyethylene with a trilobal cross-section and a polylactic acid (PLA) core. The fugitive PLA core decomposes during sulfonation and subsequent carbonization. The carbon fibers in FIGS. 6*e* and 6*f* are from completely sulfonated polyethylene core with a star-shape core and triangular pie of fugitive PLA that was removed in tetrahydrofuran solvent prior to sulfonation. The carbonized filaments in FIGS. 6*g* and 6*h* are from hollow gear-shaped PE fiber with PLA sheath. Solid gear-shaped carbon fibers produced by similar method are displayed in FIG. 6*i*. As shown, alteration in sulfonation reaction time caused variation in carbonized hollow fibers' wall thickness. In all cases, because of high carbon yield, the shape of the precursor fiber was retained in both partial and complete sulfonation conditions.

Furthermore, the end morphology of targeted fiber (consolidated vs. mesoporous) and the mechanical properties can be tailored by controlling the properties of the precursor fibers and varying processing conditions. Various mechanical properties of the polyethylene precursor fibers and the carbonized filaments produced therefrom are provided in Table 1 below. Less orientation in the precursor fiber results in the production of weaker carbonized filaments when processed under similar condition. The filament that was carbonized under constant length (i.e., restricted shrinkage) produced high modulus and strength. This is presumably due to retention of filament orientation along the fiber axis during heat treatment steps.

TABLE 1

Tensile properties of polyethylene precursor fibers and their carbonized filaments.

| Fiber Type | Filament Diameter (μm) | Max. Filament Stress (MPa) | Max. Modulus (GPa) | Ultimate Elongation (%) | Remarks |
|---|---|---|---|---|---|
| Precursor-ID R1 | 16 | 97 | 0.14 | 190 | DS-(N/A); Crystallinity 58% |
| Precursor-ID PEIII | 19 | 152 | 1.03 | 100 | DS-(N/A); Crystallinity 54% |
| Stabilized version of R1 | 21 | 69 | 1.38 | 25 | DS-(0.4 (mol (sulfonic acid)/mol (LLDPE))) |
| Stabilized version | 28 | 48 | 1.38 | 12 | DS-(0.4 (mol (sulfonic |

TABLE 1-continued

Tensile properties of polyethylene precursor fibers and their carbonized filaments.

| Fiber Type | Filament Diameter (μm) | Max. Filament Stress (MPa) | Max. Modulus (GPa) | Ultimate Elongation (%) | Remarks |
|---|---|---|---|---|---|
| of PEIII | | | | | acid)/mol (LLDPE))) |
| Carbonized filaments from R1 | 15 | 634 | 27.6 | 1.6 | Carbonized at 1200° C. under no tension |
| Carbonized filaments from PEIII | 15 | 1103 | 103.4 | 1.1 | Carbonized at 1200° C. under constant length |

EXAMPLE 2

Preparation of Carbon Fiber from Partially-Sulfonated Precursors

Materials

Partially stabilized version of PEIII sample shown in Table 1 with DS<0.4 (mol (sulfonic acid)/mol (LLDPE repeat unit)).

Processing

In one experiment, sulfonated tow was directly heat-treated at 1700° C. for two minutes at no tension. In a second experiment, the sulfonated tow first heat treated at 165° C. for two minutes at a tension of 0.8 mN/filament (~0.3 Pa), followed by direct high temperature (1700° C.) carbonization as in the first experiment. In third experiment, after 165° C. heat treatment for two minutes, fiber tow was heat-treated sequentially at 200, 600, 1200, and 1700° C. under no tension for two minutes residence time at each step.

DISCUSSION

Figure 7A:
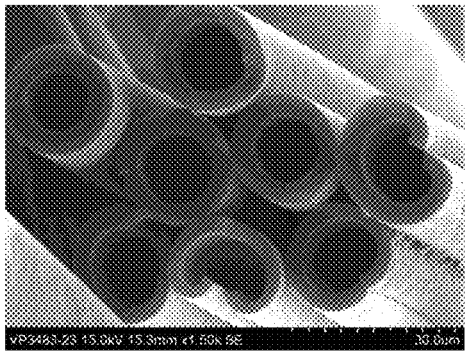
FIGS. 7*a*-7*c*. SEM micrographs of carbonized fibers obtained from partially sulfonated polyethylene tow by (a) direct heat treatment at 1700° C. for 2 minutes with no tension, which resulted in 100% hollow fiber; (b) heat treatment at 165° C. for 2 minutes with a tension of 0.8 mN/filament (~0.3 Pa) followed by direct high temperature (1700° C.) carbonization, which resulted in 50% hollow fiber with larger wall thickness; (c) heat treatment at 165° C. for two minutes followed by sequential heat treatment at 200, 600, 1200, and 1700° C. under no tension for 2 minutes residence time at each step, which resulted in thicker wall hollow fiber and solid fibers (statistically 30% hollow fiber).
Figure 7B:
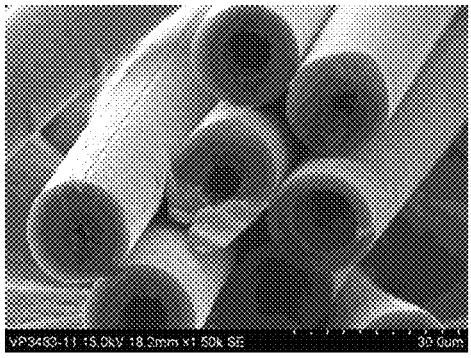
Figure 7C:
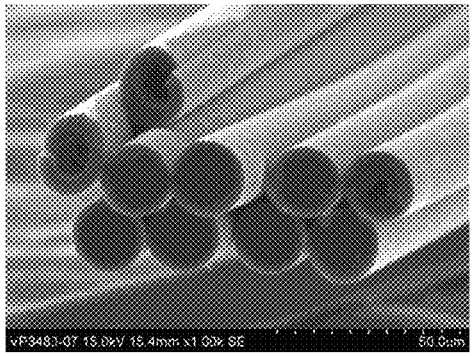

FIGS. 7*a*-7*c* depict SEM micrographs for carbonized filaments obtained from the foregoing three experiments. Direct heat treatment of partially-sulfonated polyethylene resulted in 100% hollow carbon fiber with average wall thickness of 2-3 micron (FIG. 7*a*). Annealing of sulfonated tow at 165° C. for two minutes resulted in an improvement in the degree of crosslinking or stabilization via sulfonation-desulfonation equilibrium and resulted in statistically 50% hollow fiber with an increased wall thickness (FIG. 7*b*). Further intermediate temperature heat treatments, such as at 165, 200, 600, 1200° C. of the same sulfonated precursor resulted in a 30% hollow filament (FIG. 7*c*). Approximately 10-20 individual filaments were inspected under SEM. Based on this result, an intermediate desulfonation step can be particularly useful for achieving mesoporous, microporous, or completely solid carbon fiber from a partially-sulfonated polyolefin precursor. Rapid carbonization of partially sulfonated precursor fiber, without an intermediate heat treatment step, eliminates the core non-sulfonated component as it does not provide crosslinking or structural stabilization; therefore, such process results in a hollow carbon fiber.

While there have been shown and described what are at present considered the preferred embodiments of the invention, those skilled in the art may make various changes and modifications which remain within the scope of the invention defined by the appended claims.

What is claimed is:

1. A method for the preparation of carbon fiber from polyolefin fiber precursor, the method comprising partially sulfonating said polyolefin fiber precursor to produce a partially sulfonated polyolefin fiber, and subjecting said partially sulfonated polyolefin fiber to carbonization conditions to produce said carbon fiber.

2. The method of claim 1, wherein said polyolefin fiber precursor is partially sulfonated at a temperature of at least 30° C. and up to 180° C. for a time up to 1 hour.

3. The method of claim 1, wherein said polyolefin fiber precursor is partially sulfonated at a temperature of at least 50° C. and up to 160° C. for a time up to 1 hour.

4. The method of claim 1, wherein said polyolefin fiber precursor is partially sulfonated at a temperature of at least 70° C. and up to 120° C. for a time less than 1 hour.

5. The method of claim 1, wherein said partial sulfonation is accomplished by submerging said polyolefin fiber precursor in oleum-containing sulfuric acid for a time less than the time required for complete sulfonation of said polyolefin fiber precursor.

6. The method of claim 1, wherein said polyolefin is selected from polyethylene, polypropylene, and combinations thereof.

7. The method of claim 1, further comprising producing said polyolefin fiber precursor by a melt-spinning process.

8. The method of claim 1, further comprising producing said polyolefin fiber precursor by a solution-spinning process.

* * * * *